US009395142B2

(12) United States Patent
Rodich et al.

(10) Patent No.: US 9,395,142 B2
(45) Date of Patent: Jul. 19, 2016

(54) CROSSBOW AND CLIP FOR USING THE SAME

(71) Applicant: NXT GENERATION, LLC, Akron, OH (US)

(72) Inventors: Rudy D. Rodich, Aurora, OH (US); Joe G. Box, Twinsburg, OH (US); Frank C. Dolana, North Highland, UT (US)

(73) Assignee: NXT GENERATION, LLC, Akron, OH (US)

( * ) Notice: Subject to any disclaimer, the term of this patent is extended or adjusted under 35 U.S.C. 154(b) by 0 days.

(21) Appl. No.: 14/621,825

(22) Filed: Feb. 13, 2015

(65) Prior Publication Data

US 2015/0233666 A1 Aug. 20, 2015

Related U.S. Application Data

(60) Provisional application No. 61/940,033, filed on Feb. 14, 2014.

(51) Int. Cl.
*F41B 5/12* (2006.01)

(52) U.S. Cl.
CPC ..... *F41B 5/126* (2013.01)

(58) Field of Classification Search
CPC ..... F41B 5/126; F41B 5/1403; F42B 39/007; F42B 39/26
USPC ..... 473/527
See application file for complete search history.

(56) References Cited

U.S. PATENT DOCUMENTS

| | | | | |
|---|---|---|---|---|
| 3,494,345 | A * | 2/1970 | Griffiths | F41B 7/025 124/19 |
| 5,515,837 | A | 5/1996 | Nin et al. | |
| 5,605,140 | A | 2/1997 | Griffin | |
| 5,701,878 | A | 12/1997 | Moore et al. | |
| 6,868,845 | B1 * | 3/2005 | Moore | F41B 5/126 124/25 |
| 7,537,001 | B2 | 5/2009 | Ma | |
| 7,882,829 | B2 | 2/2011 | Witzigreuter | |
| 8,057,309 | B1 | 11/2011 | Mead et al. | |
| 8,387,605 | B2 | 3/2013 | Brown et al. | |
| 8,402,958 | B2 | 3/2013 | Victor et al. | |
| 8,596,254 | B2 | 12/2013 | Brooks et al. | |
| 2006/0046877 | A1 | 3/2006 | Gajda, Jr. | |
| 2010/0147277 | A1 | 6/2010 | Zimmerman et al. | |
| 2011/0041821 | A1 | 2/2011 | Brown et al. | |
| 2011/0083653 | A1 * | 4/2011 | Kawashima | F41B 11/55 124/57 |
| 2012/0125307 | A1 | 5/2012 | Bromley et al. | |

* cited by examiner

*Primary Examiner* — Gene Kim
*Assistant Examiner* — Jeffrey Vanderveen
(74) *Attorney, Agent, or Firm* — Rankin, Hill & Clark LLP

(57) ABSTRACT

A bow having a firing assembly that allows multiple projectiles in a clip to be selectively fired by a bow string, the bow having a bow string to produce the launching force to launch the projectiles along a projectile track, a firing assembly partially contained in the clip, the clip having an outer shell with a clip opening and a biased projectile follower to urge the projectiles toward the clip opening, the bow further including a receiver having a receiver opening to selectively operably receive the clip, the clip having a firing portion with at least one projection configured to support the bow string to fire the bow, the firing assembly further including a trigger assembly joined relative to the receiver and having a firing finger configured to urge the bow string off of the at least one projection and launch a projectile.

19 Claims, 7 Drawing Sheets

CROSSBOW AND CLIP FOR USING THE SAME

This application claims priority to provisional patent application Ser. No. 61/940,033 filed on Feb. 14, 2014, which is incorporated by reference herein.

The invention of this application relates in general to a bows and, more particularly, to a crossbow that can shoot multiple projectiles. While it has been found that the invention of this application works well in connection with toy crossbows, it can be used in connection with a wide range of crossbows including adult crossbows. Further, it could also be used with other bow configurations. However, in the interest of brevity, it is being discussed in this application primarily in connection with toy crossbows.

BACKGROUND OF THE INVENTION

Archery bows have been around for a long time and come in many forms. Archery bows essentially started as simple structures that included a string attached to a long shaft and the bending of the shaft produced the energy needed for the string to propel an arrow. Over the years, this simple design has been improved to increase shooting speeds, improve accuracy and to reduce holding forces when the bow and arrow are in the shooting position. The advances in the design have resulted in significant improvements of the once simple archery bow. This even included the introduction of the crossbow that combined the function and features of an archery bow with the shooting style of a long gun. However, even with all of the advancements in this industry, archery bows and crossbows are only configured to hold a single arrow or projectile wherein the user must manually load each arrow or projectile between shots. As a result, even though the bow and arrow have been improved, the archer must reload the bow between each shot, which greatly reduces the ability to quickly shoot multiple arrows. While the skilled archer can quickly pull arrows from his or her quiver between shots, this still takes time and can take a significant amount of time for the less skilled archer. Therefore, there is a need for a crossbow that can hold multiple arrows or projectiles wherein the archer can shoot multiple projectiles quickly without reloading the bow.

The same is true with toy bows. While these toy products have been around for many years and have enjoyed many of the same advancements, toy bows also have the same inherent shortcoming wherein they are only capable of holding a single arrow or projectile.

Yet even further, the layout of a crossbow is such that the flow of multiple projectiles must be controlled to allow for the cocking of the bow string. Yet further, the layout of the crossbow is also such that projectiles not intended to be shot from the crossbow can be loaded into the arrow track and shot from the crossbow. As can be appreciated, this can damage the crossbow and can allow for unintended uses of the device. Thus, crossbows present yet additional challenges to allow for the capabilities of supporting multiple projectiles for quick sequential firing.

Accordingly, there is a need for a crossbow that can support more than one projectile and can quickly move the multiple projectiles into a firing position without reloading the crossbow. Further, there is a need to control the flow of the projectiles and to reduce or eliminate the ability to shoot unintended projectiles from the crossbow.

For this application, a crossbow is any crossbow like structure that can shoot a projectile in a way similar to an archery crossbow. This can include, but is not limited to, crossbows using traditional limbs with the bow string merely attached to the ends of the limbs, compound action crossbows that include performance enhancers, and/or any other variation or style known in the archery field or will be known in the field. These bows include toy crossbows that can shoot a projectile similar to that of a real bow referenced above, but that can be used as toys and with different projectiles. The invention of this application could even be used in connection with youth bows intended for older children and which can shoot more traditional arrows. The projectiles can by any projectile configured to be launched by a crossbow and which can vary in view of the use of the bow. Further, the projectiles can be newly designed projectiles that are designed to take advantage of the invention of this application. These projectiles can include, but are not limited to, a traditional archery arrow, hunting arrows, non-lethal arrows, target arrows, arrows with modified ends (such as with suction cups or Velcro), foam projectiles (such as those used in NERF products sold by HASBRO). Arrows are a subset of projectiles and can be any arrow like projectile including, but not limited to, traditional archery arrow, hunting arrows, non-lethal arrows, target arrows, arrows with modified ends (such as with suction cups or Velcro), foam arrows, but which directly engage a bow string. And, variations of these examples provided above. These toy bows have been successful over the years and come in a wide variety of configurations. Essentially, these toy crossbows launch projectiles based on stored energy in a string, air power and/or spring power.

INCORPORATION BY REFERENCE

U.S. Pat. No. 5,515,837 to Nin et al discloses a launch structure for a projectile and is incorporated by reference for showing the same. Published application Pub. No. 2011/0041821 to Brown et al discloses a launch structure for a projectile and is incorporated by reference for showing the same. U.S. Pat. No. 7,882,829 to Witzigreuter discloses a projectile launcher and is incorporated by reference for showing the same. U.S. Pat. No. 7,537,001 to Ma discloses a toy gun for launching a dart and is incorporated by reference for showing the same. Published application Pub. No. 2012/0125307 to Brooks et al discloses a launch structure for a projectile and is incorporated by reference for showing the same. U.S. Pat. No. 8,057,309 to Mead et al discloses a launch structure for a projectile and is incorporated by reference for showing the same. U.S. Pat. No. 5,701,878 to Moore et al discloses a launch structure for a projectile and is incorporated by reference for showing the same. U.S. Pat. No. 5,605,140 to Griffin discloses a launch structure for a projectile and is incorporated by reference for showing the same. Published application Pub. No. 2006/0046877 to Gajda, Jr. discloses foam projectiles and is incorporated by reference for showing the same.

SUMMARY OF THE INVENTION

The invention of this application relates to archery like bows and more particularly to crossbows that can support more than one projectile and quickly move one of the multiple projectiles into a firing position.

More particularly, the invention of this application relates to a crossbow that includes a clip mechanism that can hold projectiles and which selectively presents one of the projectiles in a projectile, arrow and/or firing track of the crossbow after the crossbow string is cocked.

Accordingly to another aspect of the invention, provided is a crossbow wherein the projectile track works with the clip mechanism to prevent unwanted projectiles from being loaded onto the projectile track.

According to one set of embodiments, wherein the clip mechanism includes a selectively removable clip mechanism that includes a portion of the trigger assembly that prevents the crossbow from being cocked and/or fired when the clip is removed from the crossbow.

According to another set of embodiments, the selectively removable clip mechanism includes a removable clip mechanism that will not feed a projectile until after the crossbow string is in the firing position.

According to yet another set of embodiments, the crossbow includes a removable clip that includes a firing prevention block that prevents the bow string from being cocked and/or fired when the clip is empty.

According to another set of embodiments, the clip assembly includes a string retainer for the bow string such that the bow string cannot be held in the firing position by the trigger assembly unless the clip mechanism is in place.

According to a further set of embodiments, the string retainer for the bow string is also operably connected to a projectile retainer that prevents a projectile from moving onto the projectile track until after the bow string is in the firing position.

These and other objects, aspects, features and advantages of the invention will become apparent to those skilled in the art upon a reading of the Detailed Description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DESCRIPTION OF PREFERRED EMBODIMENTS

Figure 1:
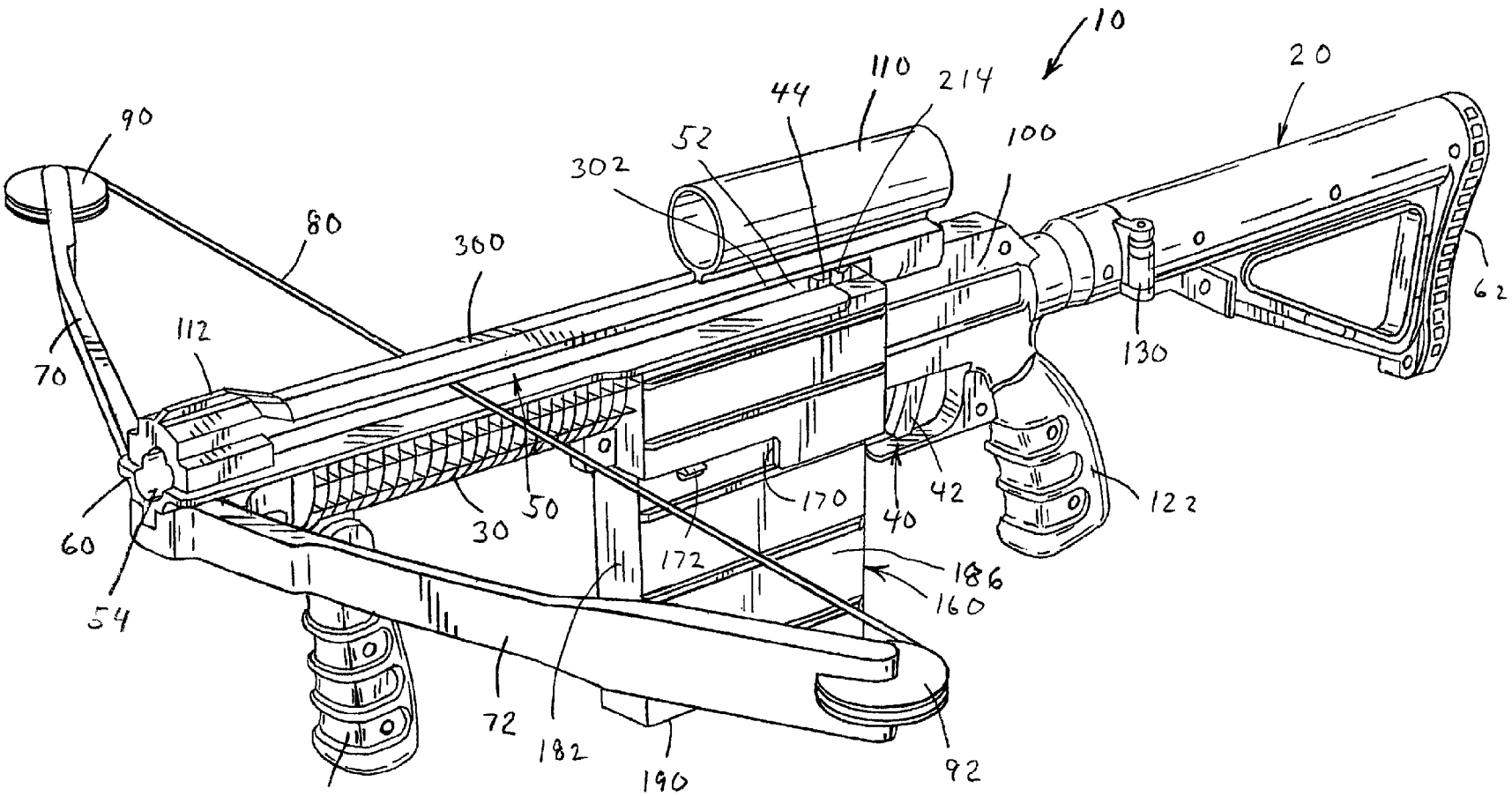
FIG. 1 is a front perspective view of a crossbow in accordance with certain aspects of the present invention.
Figure 2:
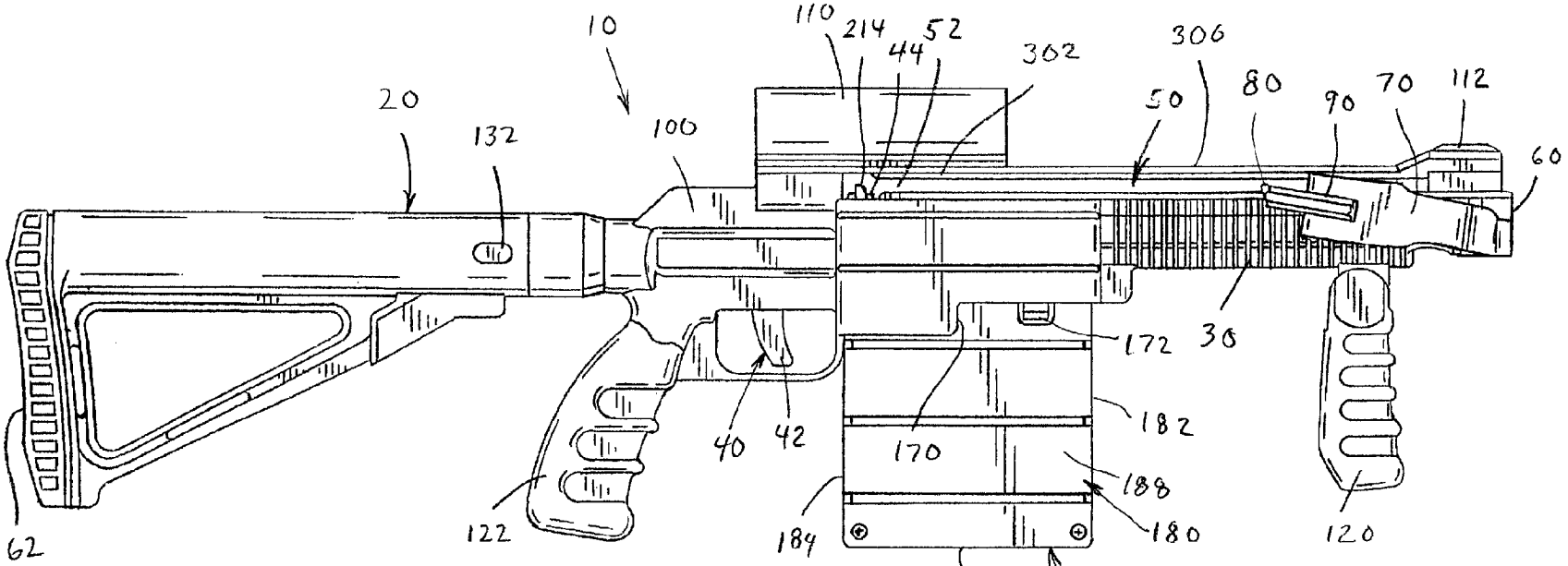
FIG. 2 is a right side view of the bow shown in FIG. 1.
Figure 3:
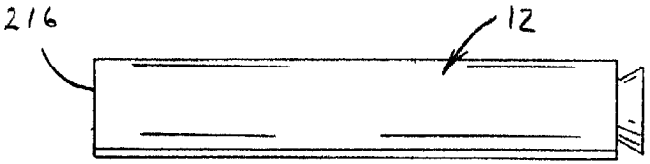
FIG. 3 is a side view of a projectile.
Figure 4:
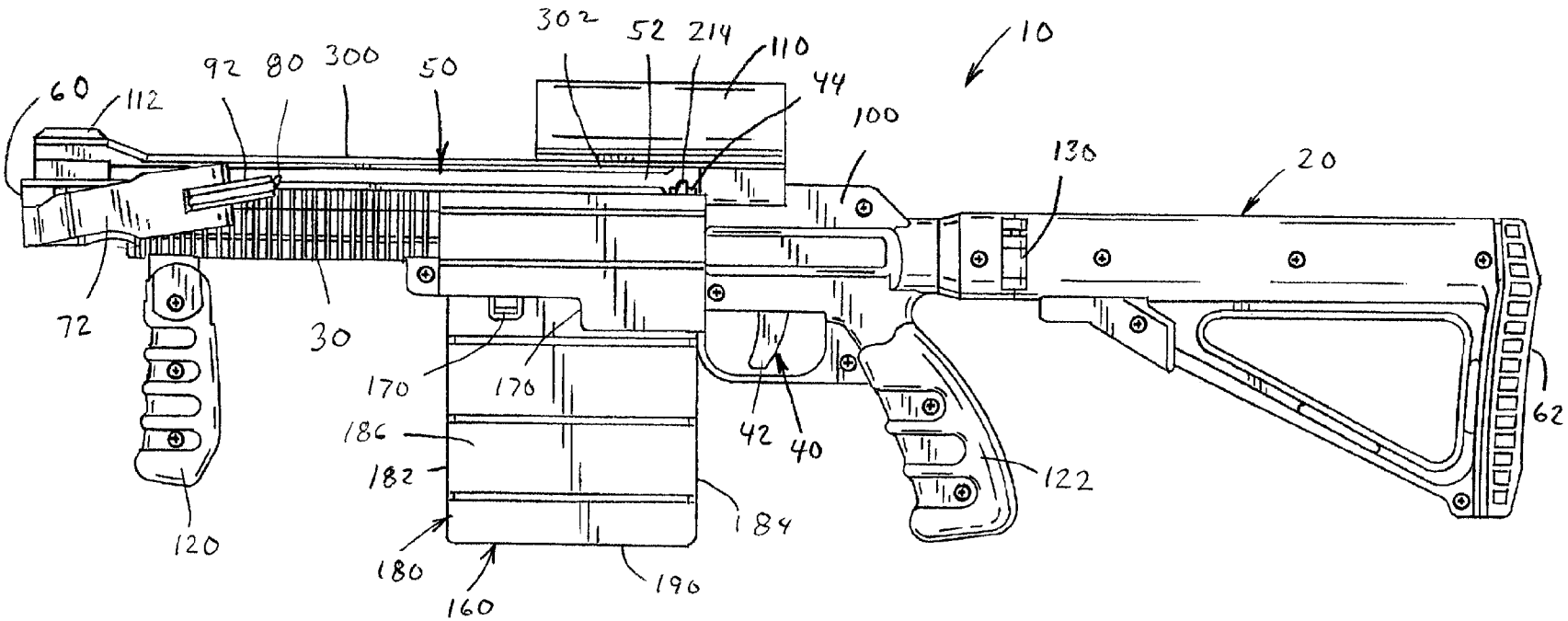
FIG. 4 is a left side view of the bow shown in FIG. 1.
Figure 5:
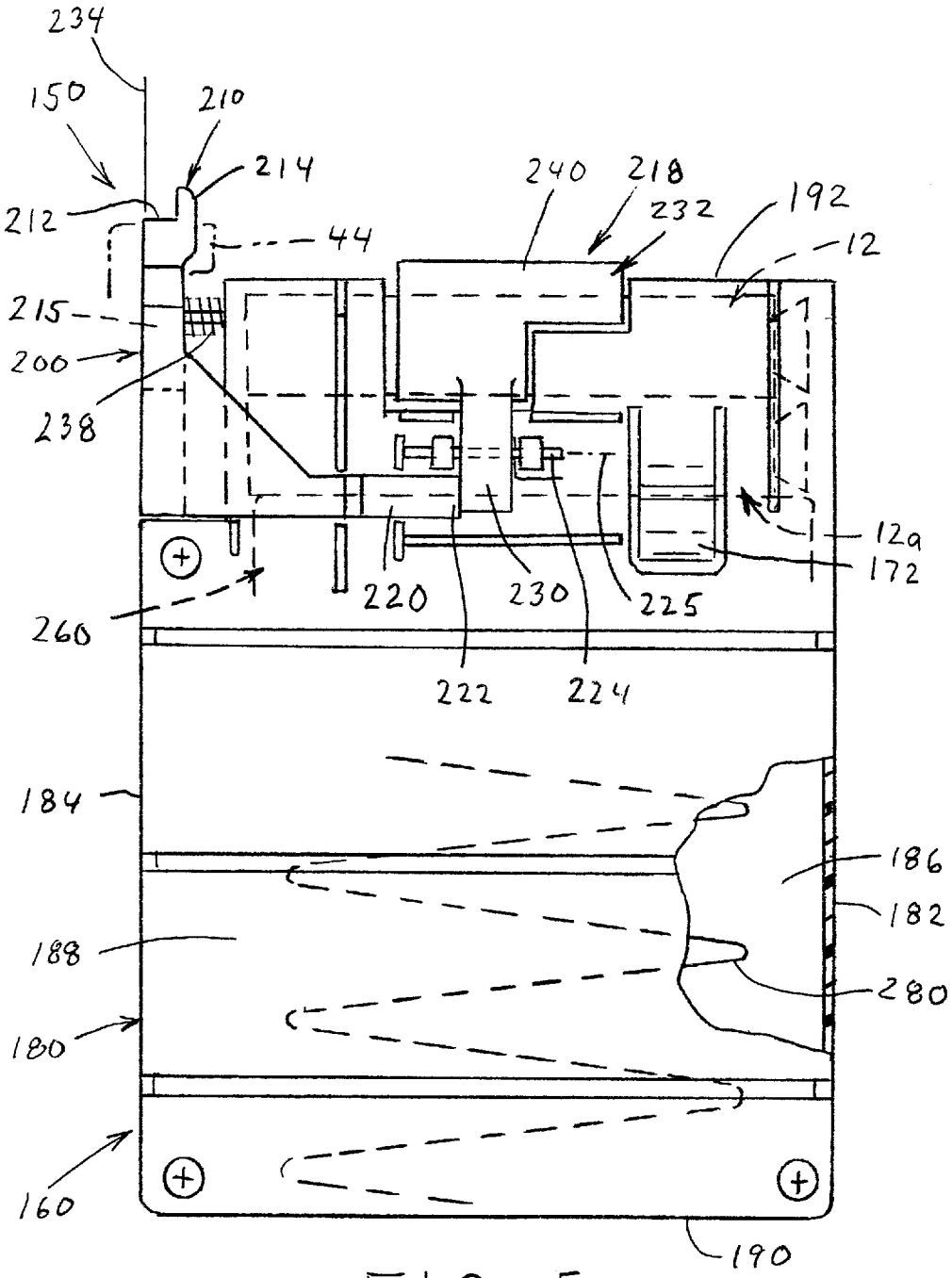
FIG. 5 is an enlarged right side of a clip for the bow shown in FIG. 1.
Figure 6:
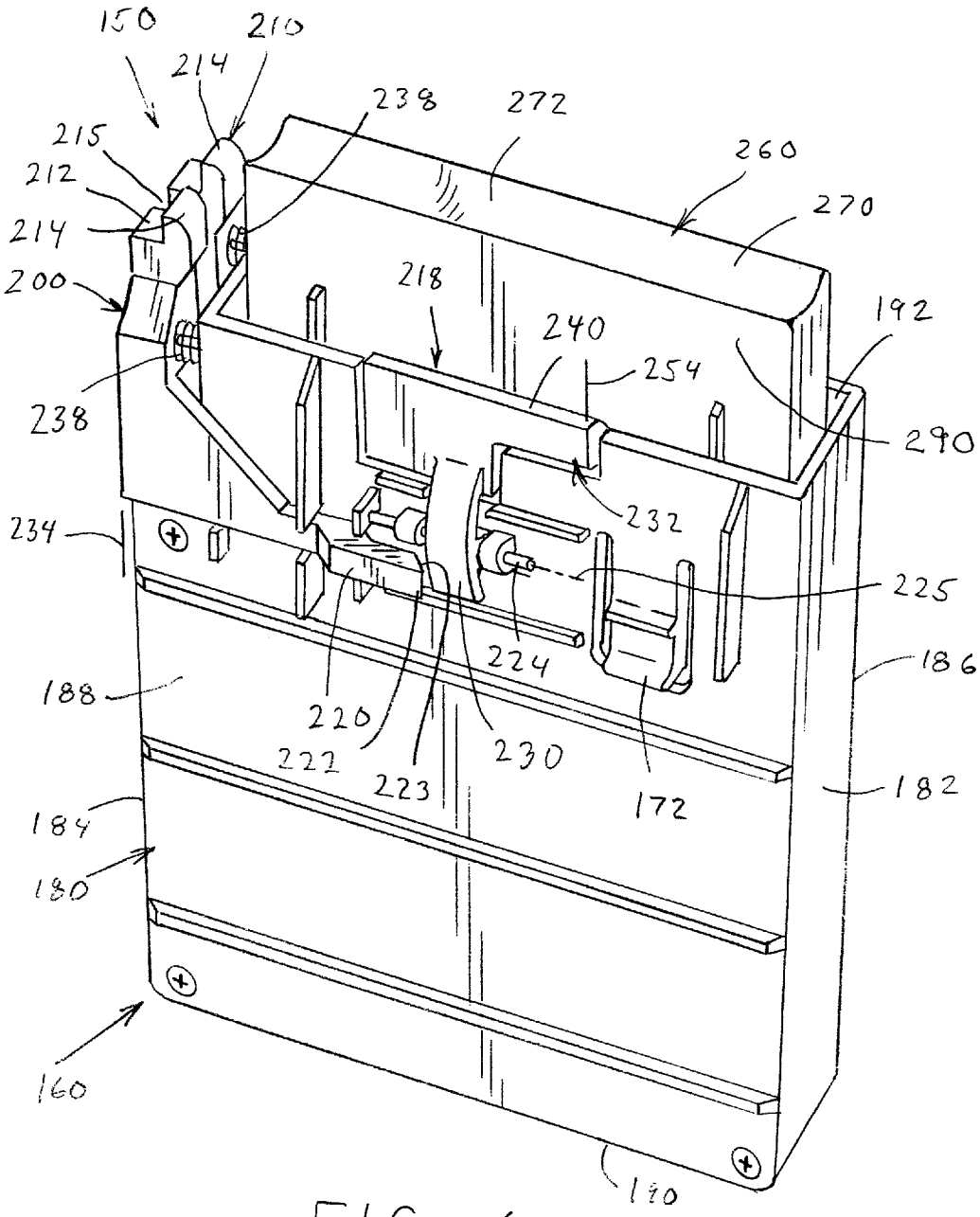
FIG. 6 is an enlarged top right side perspective of the clip shown in FIG. 5 with a firing portion in a rearward position.
Figure 7:
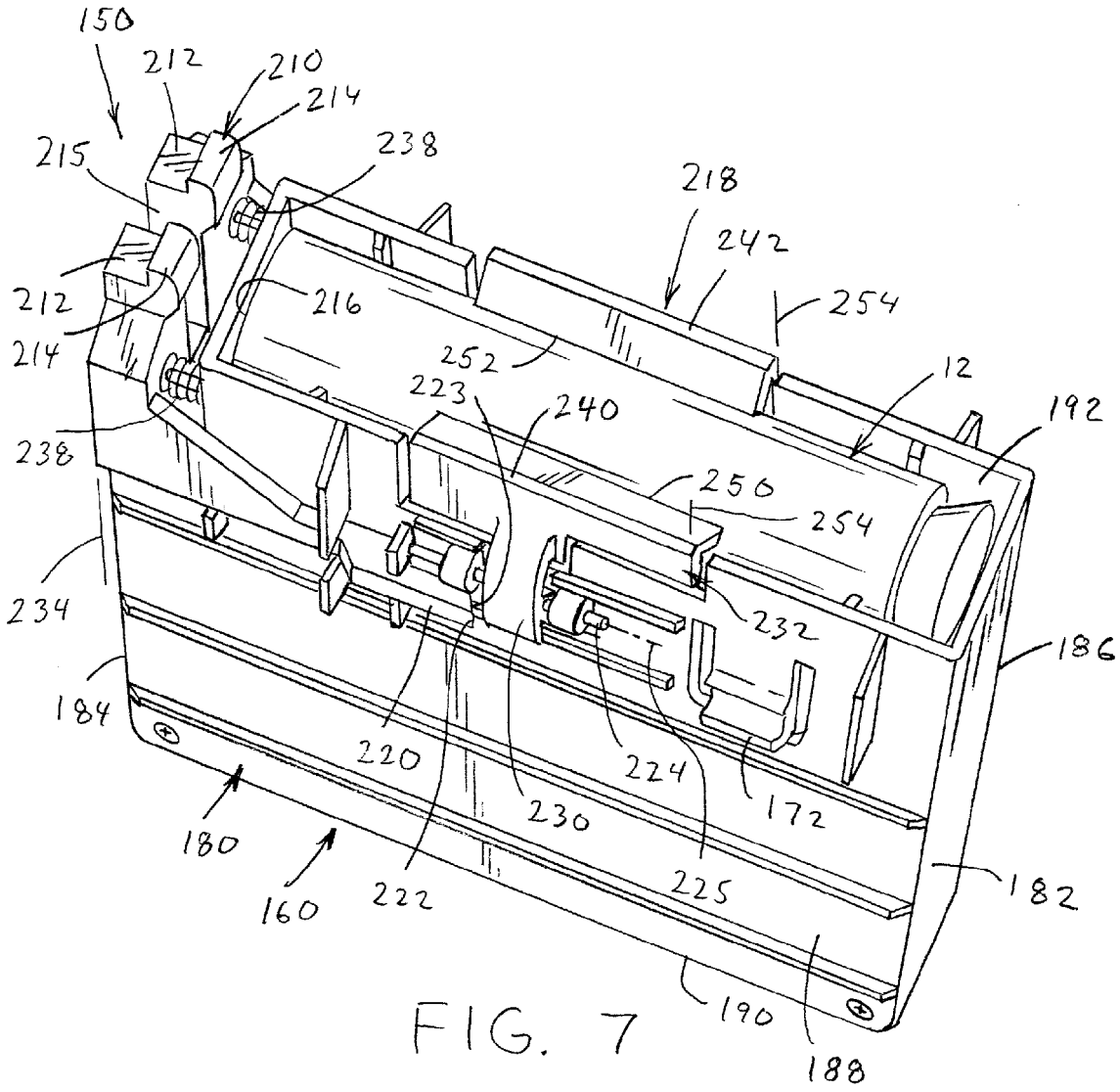
FIG. 7 is an enlarged top right side perspective of the clip shown in FIG. 5 with a projectile in place; and, FIG. 8 is an enlarged top right side perspective of the clip shown in FIG. 6 wherein the firing portion is in a forward position.

Referring now to the drawings wherein the showings are for the purpose of illustrating preferred and alternative embodiments of the invention only and not for the purpose of limiting the same, FIGS. 1-8 show a bow 10 that is configured to launch or shoot a projectile 12. Again, while the disclosure of this application shows a particular type of bow and projectile, the invention of this application is not to be limited to the particular bow configuration and/or projectile wherein a wide range of bows and projectiles could be used in the invention of this application without detracting from the invention of this application.

Bow 10 can have a wide range of structural configuration without detracting from the invention of this application. In a preferred set of embodiments, bow 10 is a crossbow and the figures illustrate an example of the same wherein bow 10 is a crossbow and is formed with traditional crossbow features and configuration. This includes a bow that has compound bow limb features, but these features are not required.

In greater detail, crossbow 10 includes a stock 20 with a foregrip 30. Crossbow 10 further includes a trigger assembly 40 having a trigger 42 and a firing finger 44. Above foregrip 30 is a projectile track 50 having a first end 52 near the trigger assembly and a distal end 54 at or near a front end 60 of the crossbow. Crossbow 10 generally extends between front end 60 and a rear end 62 in stock 20 for the crossbow design shown. However, while a particular crossbow design is shown, the physical characteristics and features of the crossbow of this application can include a wide range of configuration and features in the crossbow art without detracting from the invention of this application wherein the general shape of the crossbow is not needed to practice the invention and is being provided only for illustrative purposes.

Crossbow 10 further includes limbs 70 and 72 connected at or near front end 60. The limbs or limb assemblies join a bow string 80 to crossbow 10. In the example shown, limbs 70 and 72 can provide the stored energy to propel projectile 12 in any way known in the art wherein the particular design shown is not required. Yet further, limbs 70 and 72 can include string supports 90 and 92, respectively, which can utilize any technology known in the art. In this respect, supports 70 and/or 72 can be an opening in the limb assembly, a mounted arrangement on the limb assembly to support the string, a cam or pulley (such as those used on compound bows), an idler wheel or pulley, string supports that are intended to look like cams or idler pulleys, and/or the like.

Crossbow 10 further includes a receiver 100 that can be separate from stock 20 and which houses trigger assembly 40. Further, crossbow 10 can include any number of sights including a rear sight 110 and a front sight 112. Yet even further, crossbow 10 can include any grips known in the art. This can include a more traditional foregrip 30 disclosed above and other grips. As is shown, crossbow 10 also includes a second foregrip 120 and a pistol grip 122. Yet another feature is that stock 20 can be a folding stock wherein crossbow 10 can include a stock hinge 130 with a pivot lock 132. In one set of embodiments, lock 132 includes a push button lock arrangement that can allow for selective folding of stock 20 relative to receiver 100.

The invention of this application relates to a firing assembly 150 that includes features that allow multiple projectiles to be secured and held relative to crossbow 10 and which controls both the chambering of the projectiles and the use of the crossbow. In greater detail, cross bow 10 includes a clip or magazine assembly 160 that is shaped to be received in a receiver opening 170 of crossbow 10. Receiver 100 and/or clip 160 can include a clip release mechanism 172 that can be any release mechanism known in the art.

Clip 160 can be sized based on the projectile that is to be fed into the crossbow and/or a desired look of the crossbow. Further, the basic configuration of the clip and the receiver opening can follow a wide range of existing configuration without detracting from the invention of this application. As is shown, clip assembly 160 is a traditional rectangular clip that includes an outer shell 180 having a front 182, a rear 184 and sides 186 and 188. Clip 160 further includes a base or bottom 190 and a top opening 192. Again, these general configurations can be any configurations known in the art and others.

In addition, clip 160 includes a firing portion 200 that is moveable relative to shell 180 and works in connection with trigger 40 to fire a projectile. Firing portion 200 includes a string retainer or latch 210 having a ledge portion 212 and upward projections 214. String retainer or latch further includes a finger slot 215 between upward projections 214 to allow the firing finger 44 to pass therebetween. As will be discussed more below, cocking the crossbow for firing includes drawing back bow string 80 and positioning bow string 80 behind upward projections 214. Further, bow string 80 is oriented onto or near ledge portion 212. Upward projections 214 then maintain bow string 80 in a firing or cocked condition. When trigger 42 or trigger assembly 40 is pulled by the user, trigger 42 moves trigger finger 44 upwardly and/or forwardly between projections 214 such that finger 44 engages bow string 80 and urges bow string 80 up from ledge 212 and over upward projections 214 wherein the bow string is allowed to launch forwardly across projectile track 50. Thus, it is preferred that firing portion 200 is oriented at least near rear 184 of clip so that at least ledge 212 and projections 214 are behind a back edge or side 216 of projectile 12 when clip is in an operable position within the receiver.

Figure 8:
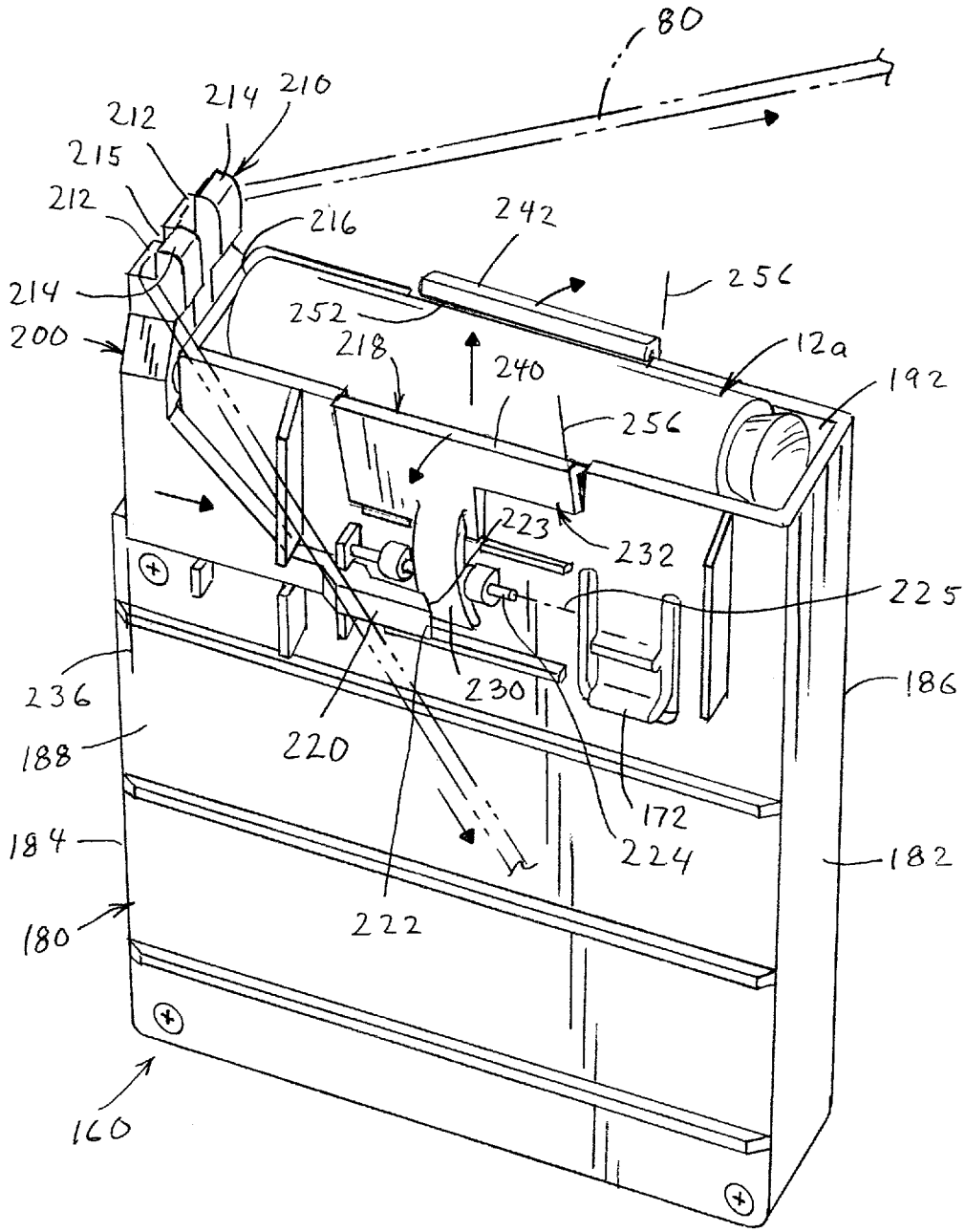

Firing portion 200 can further include an actuation mechanism 218 that can control the retention and release of projectiles 12 from the clip into a firing position on track 50. In this respect, the embodiment shown has a firing portion 200 that includes at least one actuation arm 220 to control the release of the projectiles from the clip onto track 50 wherein the projectile is prevented from moving onto or in alignment with the projectile track until after the string is cocked. In this respect, at least one arm 220 is configured to engage a release lever 230 of a projectile retainer 232 and actuate the projectile retainer for the selective flow or release of one of projectiles 12 onto and/or in alignment with track 50. Arm(s) 220 can include a distal end 222 that includes a ramp or cam surface 223. Release lever 230 can be pivotal about a release lever axil 224 such that arm(s) 220 pivot about a lever axis 225. In operation, retainer 232 maintains or retains projectiles 12 within clip 160 until the crossbow is cocked. In this respect, firing portion 200 is configured to actuate to allow for this control of the projectiles in the clip. In the embodiment shown, firing portion 200 actuates by sliding relative to clip shell 180 generally parallel to top opening 192 between a rearward position 234 (FIG. 6) and a forward position 236 (FIG. 8). Firing portion 200 can further include a biasing member 238 that can bias the assembly rearwardly toward position 234, which will be discussed more below. Projectile retainer 232 can include a pair of opposed projectile clips 240 and 242 that include inwardly facing barbs 250 and 252, respectively. Opposed projectile clips 240 and 242 and/or barbs 250 and 252 can be inwardly biased such that they control upward movement of projectiles 12 out of clip opening 192. As can be appreciated, this can retain the projectiles within the clip for when the clip is being loaded with projectiles 12 to prevent the projectiles from inadvertently falling out of the clip. But, as will be discussed more below, the projectile clips 240 and 242 and/or barbs 250 and 252 also prevent one of projectiles 12 from being presented onto or in alignment with projectile track 50 until after bow string 80 is positioned onto the trigger assembly thereby allowing crossbow 10 to be cocked even with multiple projectiles secured thereto. In this respect, when firing portion 200 is in rearward position 234, clips 240 and 242 and/or barbs 250 and 252 are in a locked condition 254 and projectiles are prevented from moving upwardly out of clip opening 192. But, when firing portion 200 is moved toward forward position 236, ramps 223 engage lever 230 thereby rotating lever 230 about lever axis 225 wherein clips 240 and 242 and/or barbs 250 and 252 are pivoted toward an unlocked condition 256. Thus, projectile 12 is allowed to move upwardly out of the clip. As will be discussed more below, the force of the bow string is used to move the firing portion to the forward position.

Clip 160 can further include a projectile follower 260 that includes a projectile ramp 270 and a biasing member 280 that forces ramp 270 upwardly toward opening 192. Follower 260 further includes a block extension 290 sized to fit outwardly of opening 192 after all projectiles are withdrawn from the clip, which will be discussed more below. Follower 260 and/or clip 160 can further include a stroke limiting feature to retain the projectile follower in an operation position within the clip. Yet further, projectile ramp 270 can include a projectile track portion 272 that can be configured at least similar to track 50 to allow resistance free launching of the final projectile in the clip.

In operation, projectiles 12 are first loaded into clip 160 through clip opening 192. As they are urged into the clip, they are forced passed projectile clips 240 and 242 and/or barbs 250 and 252 wherein levers 230 pivot about lever axis 225 to allow each projectile to enter the clip and be retained within the clip after they pass clips 240 and 242 and/or barbs 250 and 252. This action forces follower 260 down into the clip toward bottom 190 wherein the projectiles are positioned between follower 260 and opening 192. As more projectiles are positioned in the clip, follower 260 approaches clip bottom 190. Biasing member 280, which can be any biasing member known in the art including, but not limited to a coil or compression spring, maintains an upward force on the projectiles thereby continuously urging projectiles 12 upwardly toward opening 192 and against clips 240 and 242 and/or barbs 250 and 252, but the projectiles are retained by projectile clips 240 and 242 and/or barbs 250 and 252.

Then, the clip is oriented and loaded into receiver opening 170 wherein clip 160 orients projectiles 12 relative to track 50 and at least partially below track 50. In that firing portion 200 is in rearward position 234, clips 240 and 242 and/or barbs 250 and 252 are in locked condition 254 (FIG. 6) wherein projectiles 12 are retained at least partially below track 50 and are prevented from moving upwardly into track 50. As a result, bow string 80 can be unimpededly moved along track 50 toward string retainer or latch 210 that is now in proper orientation since the clip is in the receiver. The string is move along track 50 above projectiles 12 in clip 160 and positioned onto string retainer or latch 210. Once the bow string is in place on string retainer 210 and released, the string force of bow string 80 imparts a forward force on string retainer 210, which urges it forwardly into forward position 236. This movement urges ramp 223 into levers 230 that rotates the lever about axis 225, which moves clips 240 and 242 and/or barbs 250 and 252 into unlocked position 256 (FIG. 8) and allows a single projectile 12 to move upwardly onto or in alignment with track 50. The motion is automatic wherein the projectile is automatically positioned in alignment with track 50 and forwardly of string retainer 210.

When trigger 42 is pulled, trigger or firing finger 44 urges bow string 80 up and over retainer 210 toward track 50 wherein the string launches the projectile along track 50.

However, as soon as this occurs, biasing member 238 quickly returns firing portion 200 to rearward position 234 wherein clips 240 and 242 and/or barbs 250 and 252 are moved into locked position 254. As a result, the subsequent projectile 12*a* is maintained below track 50. Subsequent projectile 12*a* can then be moved into a firing position once bow string 80 is again drawn back and placed on string retainer 210. This can be continued until all projectiles are emptied from the clip.

Once clip 160 is empty, projectile follower 260 continues its upward movement whereby block extension 290 can extend upwardly and outwardly of opening 192. This can be utilized to block access from the track toward the trigger assembly. As a result, string 80 is prevented from being cocked and/or is prevented from engaging a projectile to propel the projectile until they are properly loaded into clip 160. Thus, projectiles not design to be shot by the crossbow cannot be fired.

In another set of embodiments, crossbow 10 can further include a track cover 300 that at least partially covers projectile track 50. Track cover 300 can have multiple functions and can compliment the features and functions of firing system 150. In this respect, track cover 300 can partially cover track 50, cover over half of the track and/or fully cover track 50, but its function near firing system 150 can create the greatest benefit. In this respect, a portion of cover 300 can general cover the region near clip opening 192, receiver opening 170 and/or latch 210 in a special track region 302. In this region, cover can work in combination with follower 260 to both control the flow of projectiles into the firing position and work in combination with block extension 290 to prevent unwanted projectiles from being loaded and/or launched by the crossbow. When working with follower 260, cover 300 can limit the upward movement of projectile 12 in region 302 when it is moved into the firing position wherein it can control the top extent of this movement. Further, the portion of the cover 300 in region 302 can prevent the projectile from inadvertently falling from the firing position. Therefore, the projectile is generally or partially encapsulated into the firing position wherein movement of the bow does not result in the projectile falling out of the bow. Yet further, cover 300 can work in combination with extension 290 in region 302 to block the bow string from even being cocked. In this respect, block extension 290 can substantially fill at least a portion of this region to prevent the bow string from reaching latch 210. Therefore, even though the firing system is in place when the clip is in the receiver (regardless of whether there are projectiles in the clip), the extension 290 and cover 300 can prevent unwanted objects from being placed on the track. Further, cover 300 can prevent the bow string from being moved into the cocked position on retainer 210 when there are no projectiles in the clip.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation. Again, the invention of this application is disclosed and described in relation to a preferred set of embodiments, but should not be limited to the same. While, some structural aspects of the invention lend itself particularly useful to a crossbow configuration, this is not required. Further, direction notations in this application are in relation to the figures and should not be interpreted as limiting the disclosed invention. For example only, some aspects of the disclosed structures could be rotated to work in connection with a long bow.

It is claimed:

1. A firing assembly for an archery bow that allows multiple projectiles in a projectile clip to be selectively fired by a bow string, the bow having a projectile track and a bow string having a launching force configured to launch the projectile forwardly along the projectile track wherein the projectile track is configured to support and direct the projectile as it is shot from the bow, the firing assembly comprising a projectile clip shaped to receive a plurality of associated projectiles that include a first associated projectile and a second associated projectile, the projectile clip having an outer shell including a base and side walls extending from the base toward a clip opening, the clip further including a projectile follower and a biasing member urging the projectile follower toward the clip opening such that the associated plurality of projectiles are urged toward the clip opening and the associated first projectile is urged toward the clip opening with the associated second projectile being adjacent to the associated first projectile toward the projectile follower, the clip further including an actuatable projectile retainer that can be moved from a locked condition wherein it engages the associated first projectile and the plurality of associated projectiles are retained in the projectile clip and an unlocked condition wherein the associated first projectile can be urged out of the clip opening by the force of the projectile follower and the biasing member, the projectile clip further including a firing portion having at least one projection wherein the firing portion is operably connected to the projectile retainer such that when the firing portion is in a rear position the projectile retainer is in the locked condition and when the firing portion is in a forward position the projectile retainer is in the unlocked condition, the clip having a firing portion biasing member to urge the firing portion toward the rear position, the bow further including a bow receiver having a receiver opening shaped to selectively receive the projectile clip of the firing assembly in an operable position relative to the receiver, in the operable position the associated first projectile is adjacent a portion of the projectile track of the bow when the firing portion is in the rear position and the projectile retainer is in the locked condition thereby allowing a bow string configured to launch the associated projectiles to pass the associated first projectile and past the at least one projection to engage the at least one projection, the shooting force of the bow string engaging the at least one projection moving the firing portion forwardly from the rear position to the forward position and the projectile retainer into the unlocked condition allowing the force of the projectile follower and the biasing member to move the associated first projectile into general alignment with the projectile track, the bow further including a trigger assembly joined relative to the receiver and having a firing finger, the firing finger configured to urge the bow string off of the at least one projection, moving the bow string off of the at least one projection both causing a launch of the associated first projectile and the firing portion to automatically move back to the rear position to automatically move the projectile retainer to the locked condition and prevent the associated second projectile from exiting the clip opening.

2. The firing assembly of claim 1, wherein the trigger assembly includes a trigger and the at least one projection is a pair of projections having a slot therebetween, the firing finger being positioned generally within the slot when the clip is in the operable position to allow the firing finger to lift the bow string off of the pair of projections when the trigger is pulled.

3. The firing assembly of claim 1, wherein the actuatable projectile retainer includes a pair of opposed projectile clips.

4. The firing assembly of claim 3, wherein the pair of opposed projectile clips includes inwardly facing barbs.

5. The firing assembly of claim 1, further including a track cover and the track cover at least generally covering the projectile track above the clip opening when the clip is in the operable position defining a covered track region.

6. The firing assembly of claim 5, wherein the track cover covers the at least one projection.

7. The firing assembly of claim 5, wherein the projectile follower includes a block extension configured to extend outwardly of the clip opening into the covered track region and prevent passage of at least one of the bow string and placement of an associated unwanted projectile in the covered track region.

8. The firing assembly of claim 7, wherein the block extension includes an upward surface that forms a portion of the projectile track for launching an associated last projectile from the associated plurality of projectiles in the projectile clip.

9. The firing assembly of claim 1, wherein a portion of the projectile clip forms a portion of the projectile track.

10. A crossbow having a firing assembly that allows multiple projectiles in a projectile clip to be selectively fired by a bow string, the crossbow comprising a projectile track extending toward a front end with a bow string configured to produce a launching force and launch an associated projectile forwardly along the projectile track wherein the projectile track is configured to support and direct the associated projectile as it is shot from the crossbow, the crossbow further including a firing assembly that is partially contained in a projectile clip, the projectile clip shaped to receive a plurality of associated projectiles that include a first associated projectile and a second associated projectile, the projectile clip having an outer shell including a base and side walls extending from the base toward a clip opening, the clip further including a projectile follower and a biasing member urging the projectile follower toward the clip opening such that the associated plurality of projectiles are urged toward the clip opening and the associated first projectile is urged toward the clip opening with the associated second projectile being adjacent to the associated first projectile toward the projectile follower, the bow further including a bow receiver having a receiver opening shaped to selectively receive the projectile clip in an operable position relative to the receiver, the firing assembly including a clip firing portion in the projectile clip that includes at least one projection configured to support the bow string to fire the cross bow when the projectile clip is in the operable position, the firing assembly further including a trigger assembly joined relative to the receiver and having a firing finger, the at least one projection of the clip firing portion generally aligning with the firing finger in the receiver when the projectile clip is in the operable position such that the firing finger is configured to urge the bow string off of the at least one projection and launch the associated first projectile when in the operable position, the clip firing portion further including a projectile retainer operably joined to the at least one projection and the projectile retainer selectively securing the plurality of associated projectiles in the projectile clip, the at least one projection of the clip firing portion being movable between a rear position wherein the projectile retainer is in a locked condition and the plurality of associated projectiles are retained in the projectile clip and a forward position wherein the projectile retainer is in an unlocked condition and the associated first projectile can be urged out of the clip opening, the clip firing portion having a firing portion biasing member to urge the at least one projection toward the rear position, the force of the bow string moving the at least one projection into the forward position.

11. The cross bow of claim 10, wherein the at least one projection of the projectile clip moves relative to the outer shell of the projectile clip and includes at least one forwardly extending external arm that is operably joined to the projectile retainer to urge the projectile retainer into the unlocked condition wherein the associated first projectile can be urged out of the clip opening by the force of the projectile follower and the biasing member.

12. The crossbow of claim 10, wherein the trigger assembly includes a trigger and the at least one projection is a pair of projections having a slot therebetween, the firing finger being positioned generally within the slot when the clip is in the operable position to allow the firing finger to lift the bow string off of the pair of projections when the trigger is pulled.

13. The crossbow of claim 11, wherein the actuatable projectile retainer includes a pair of opposed projectile clips.

14. The crossbow of claim 13, wherein the pair of opposed projectile clips includes inwardly facing barbs.

15. The crossbow of claim 10, further including a track cover and the track cover at least generally covering the projectile track above the clip opening when the clip is in the operable position defining a covered track region.

16. The crossbow of claim 15, wherein the track cover covers the at least one projection.

17. The crossbow of claim 15, wherein the projectile follower includes a block extension configured to extend outwardly of the clip opening into the covered track region and prevent passage of at least one of the bow string and placement of an associated unwanted projectile in the covered track region.

18. The crossbow of claim 17, wherein the block extension includes an upward surface that forms a portion of the projectile track for launching an associated last projectile from the associated plurality of projectiles in the projectile clip.

19. The crossbow of claim 10, wherein a portion of the projectile clip forms a portion of the projectile track.

* * * * *